US006895623B2

(12) United States Patent
Zimmerlee

(10) Patent No.: US 6,895,623 B2
(45) Date of Patent: May 24, 2005

(54) PIER SYSTEM AND METHOD OF CONSTRUCTION

(75) Inventor: James D. Zimmerlee, 825 Miller Dr., Oregon, WI (US) 53575

(73) Assignee: James D. Zimmerlee, Oxford, WI (US)

( * ) Notice: Subject to any disclaimer, the term of this patent is extended or adjusted under 35 U.S.C. 154(b) by 0 days.

(21) Appl. No.: 10/605,117

(22) Filed: Sep. 9, 2003

(65) Prior Publication Data

US 2005/0050657 A1 Mar. 10, 2005

(51) Int. Cl.[7] ..... E01D 19/02
(52) U.S. Cl. ..... 14/75; 14/73; 14/77.1
(58) Field of Search ..... 14/69.5, 73, 73.1, 14/75, 76, 77.1, 77.3, 6, 27; 52/633, 650.3

(56) References Cited

U.S. PATENT DOCUMENTS 2,317,428 A * 4/1943 Anderson ..... 52/509
3,011,467 A * 12/1961 Letourneau ..... 114/265
4,282,619 A * 8/1981 Rooney ..... 14/6
4,309,125 A 1/1982 Richardson
4,329,826 A * 5/1982 Flogaus et al. ..... 52/712
4,450,121 A 5/1984 Bequette
4,646,379 A 3/1987 Muller
5,048,640 A 9/1991 McConville et al.
5,163,967 A * 11/1992 Hoffman et al. ..... 52/299
5,361,554 A * 11/1994 Bryan ..... 52/480
5,386,782 A * 2/1995 Dinis et al. ..... 104/124
5,570,486 A 11/1996 Wiedeck
5,755,981 A 5/1998 Payne
5,850,720 A * 12/1998 Willis ..... 52/650.3
5,953,874 A * 9/1999 Hoffman et al. ..... 52/299
6,128,880 A * 10/2000 Meenan, Jr. ..... 52/489.1
6,141,927 A * 11/2000 Usui ..... 52/263
6,170,105 B1 1/2001 Doyle et al.

(Continued)

FOREIGN PATENT DOCUMENTS

EP 00164936 B1 4/1992

(Continued)

OTHER PUBLICATIONS

Jacobs, G.W., Improvement of the Suspension Monorail in Wuppertal Germany, Prakitiker, Sep. 2002, pp. 316-318, Germany.

(Continued)

*Primary Examiner*—Thomas B. Will
*Assistant Examiner*—Alexandra K. Pechhold
(74) *Attorney, Agent, or Firm*—LaFollette Godfrey & Kahn; Sonali S. Srivastava

(57) ABSTRACT

A a pier system having at least one shelf beam which has a side panel and a shelf member, the shelf member supporting a decking unit, and a method for constructing the pier system. The decking unit may also be supported by connecting members, such as support bars or inverted trusses, which are attached to and span the distance between points on the shelf members of the shelf beams. Each shelf beam is coupled to at least one support post, and the support post may be connected to a sleeve that slides axially around the support post. The method involves constructing a pier frame out of at least two shelf beams and support posts, placing a decking unit upon the shelf members of the shelf beams, and extending the pier system by repeating the process and coupling successive pier frames to one another.

14 Claims, 9 Drawing Sheets

U.S. PATENT DOCUMENTS

| | | | | |
|---|---|---|---|---|
| 6,194,051 | B1 * | 2/2001 | Gagas et al. | 428/99 |
| 6,381,793 | B2 | 5/2002 | Doyle et al. | |
| 6,449,791 | B1 * | 9/2002 | Vodicka | 14/75 |
| 6,490,838 | B2 * | 12/2002 | Summerford | 52/650.3 |
| 6,520,106 | B1 * | 2/2003 | Listle | 114/263 |
| 2002/0045172 | A1 | 4/2002 | Sturm, Jr. | |
| 2003/0084523 | A1 * | 5/2003 | Szekely | 14/69.5 |

FOREIGN PATENT DOCUMENTS

| | | |
|---|---|---|
| EP | 00420065 | 10/2000 |
| JP | 07191118 | 1/1997 |
| JP | 07197858 | 1/1997 |
| JP | 08043180 | 9/1997 |
| JP | 9-281269 A | 10/1997 |
| JP | 10147006 | 12/1999 |
| JP | 10320353 | 5/2000 |

OTHER PUBLICATIONS

Zahn, F.A.; Fontana, M., Innovative Composite Construction, Schweiz, Ing. Archit., Jun. 15,1995, pp. 4-11, Jauslin & Stebler Ingenieure; ETH Honngerberg, Switzerland.

No Author, Body Structure Thing, Titaniumcrud Light Steel Board, The First Adoption, Zairyo To Kankyo, Jul. 15, 1999, p. 457, vol. 48 No. 7, Japan.

Yamaguchi, Y.: Tomita, M.: Nishida, T.: Sakai, H., Design of the Okuyama Bridge, Puresutorusuto Konku, Mar. 31, 1997, pp. 85-92, vol. 39 No. 2, Hanshin Expressway Pub. Japan.

Altabba, Bashar, Re-creating the Rainbow Bridge, Civil Engineering, 2000, pp. 32-37, vol. 70 No. 5, HNTB, Boston, MA.

Milkovich, Scott: Harik, Issam E.; Brailsford, Bruce, Composite Materials for Bridges. Construction Specifier, May 1996, pp. 102-106, vol. 49 No. 5, USA.

Gudmestad, O.T.; Warland, T.A., Optimum Use of Concrete Structures et al., Proc. Int. Meet. Pet. Eng., 1992, pp. 457-470, Soc. of Petroleum Engineers of AIME, Richardson, TX.

Anon, Prestressed Concrete Beams for the New Teifi Bridge, Concrete Plant and Production, May 1991, pp. 175-176.

No Author, Building Tougher Bridges, Metal Bulletin Monthly, Aug. 2002, p. 61, United Kingdom.

Black, S., A Survey of Composite Bridges, Composites Technology, Mar.-Apr. 2000, pp. 14-18, USA.

No Author, Composite Bridge Construction Increases, Adv. Compos. Bull., Mar. 1995, pp. 6-7, United Kingdom.

No Author,Composite Road Bridge, Adv. Comp. Bulletin, Sep. 1997, p. 8, United Kingdom.

* cited by examiner

PIER SYSTEM AND METHOD OF CONSTRUCTION

BACKGROUND OF INVENTION

The present invention is related to pier systems that traditionally are installed manually, at the edge of a body of water, such as lakes, ponds, or rivers, and often are used for launching boats and fishing, among other uses. Such pier systems may be made in a variety of dimensions, and frequently have landings that are wider than the other sections of the pier system at the portion farthest from the edge of the water. These pier systems generally support the loads of numerous people, furniture, and other equipment, and are intended to endure many seasons of use.

Various structures and methods for building pier systems are known to one of ordinary skill in the art. Conventional pier systems typically are constructed with 8-foot long beams that are not capable of supporting large loads. As shown in U.S. Patent Registration U.S. Pat. No. 6,449,791, a typical pier involves numerous parts, which may require detailed assembly and construction. Additionally, as shown in the patent, numerous support posts and cross beams are used in conjunction with the pier to avoid undesirable load on pier system structure.

The present invention overcomes the drawbacks and limitations of conventional piers and allows for yet another way of producing lightweight, economic and easy to construct piers.

SUMMARY OF INVENTION

The present invention provides a pier system that has at least one shelf beam that supports a decking unit, with each shelf beam connected to at least one support post. Each shelf beam has a side panel and a shelf member that protrudes along the entire length of the shelf beam, the shelf member providing support for the decking unit. Generally, the pier system will have at least one pair of shelf beams that supports the decking unit, although the pier system may also be made in other forms, such as from a single shelf beam, shaped like a "U" or a semicircle, or another form that allows it to support a decking unit upon its shelf member. The pier system may also include a sleeve that is axially slidable onto each support post, which is attached to the support post and the shelf beam. The sleeve may be connected to another sleeve, increasing the stability of the pier system. The decking unit may be any variety of shapes, with some embodiments having decking units that are substantially rectangular and triangular.

To further support the decking unit, the pier system may also include a connecting member, such as a support bar or an inverted truss. Such connecting member spans the distance between two points on the shelf members of the shelf beams, and allows the decking unit to rest upon the connecting member as well as the shelf members of the shelf beams, increasing the stability of the pier system. In embodiments of the pier system that include a connecting member, the shelf member of the shelf beam may have a two-tiered upper surface that facilitates simultaneous attachment of the connecting member and support of the decking unit.

The present invention further includes a method for constructing a pier system, by first erecting a pier frame by coupling at least two shelf beams to at least two support posts, and second, by placing a decking unit upon the exposed shelf members of the pier frame. A flotation device may be coupled to the pier frame and decking unit, so that the flotation device buoys the shelf beams and decking unit. The present invention also provides another method for constructing a pier system by coupling at least two shelf beams to at least two support posts and then attaching a connecting member to two points on the shelf members of the shelf beams before positioning a decking unit upon the exposed shelf beams and connecting member.

The present invention offers numerous improvements over the related art, such as providing longer beams that facilitate manual installation by virtue of their lighter weight and the requirement for fewer parts. Further, the weight advantage of the present invention makes for cheaper and easier transportation and storage of individual elements of the pier system, providing a distinct benefit to, among others, pier owners who seasonally store their pier systems and couriers who transport such pier systems. Another significant advantage over the prior art is the ability of the present invention to support considerable weight.

Other objects and advantages of the invention will become apparent hereinafter.

DETAILED DESCRIPTION

Figure 1:
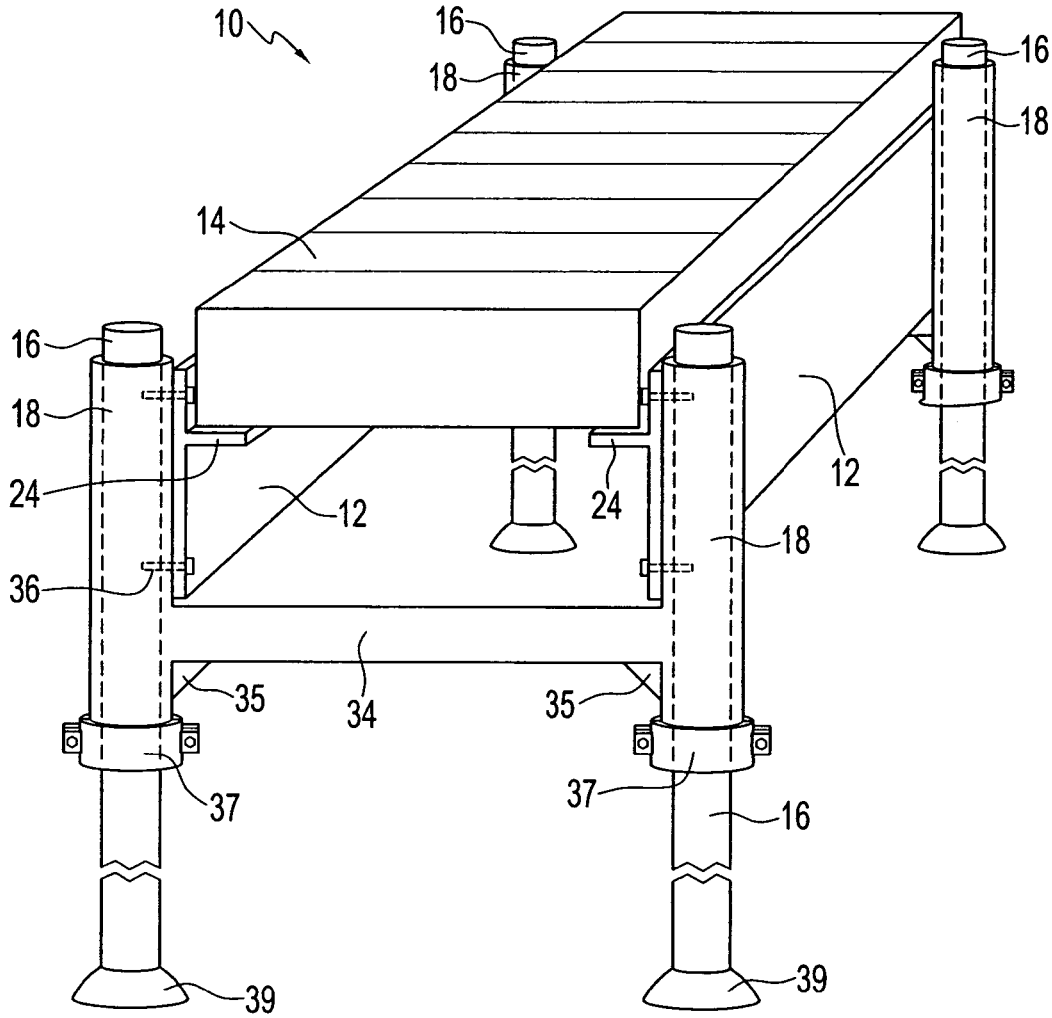
FIG. 1 is a perspective view of a pier constructed according to one embodiment of the present invention.
Figure 1A:
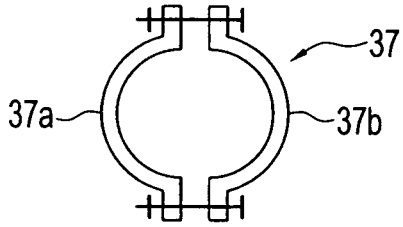

The present invention generally describes a pier system 10. The pier system 10 has a shelf beam 12, which supports at least one decking unit 14. The shelf beam 12 in turn is coupled to support posts 16 and sleeves 18, so that the pier system is capable of bearing a load.

Figure 2:
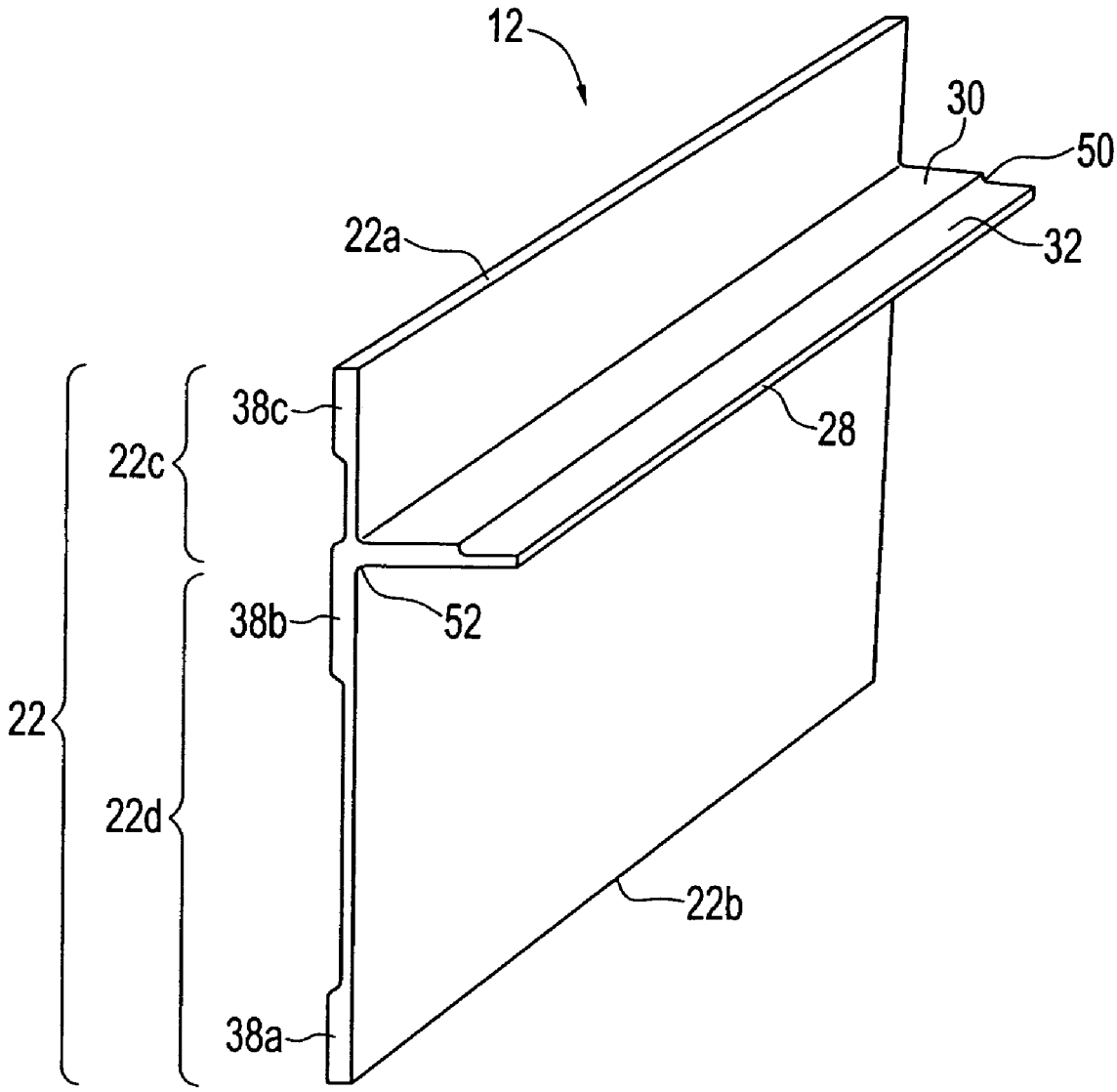
FIG. 2 is a perspective view of the preferred embodiment of the shelf beam disclosed in the present invention.

Referring now to FIG. 1, the invention provides a pier system 10 which generally includes a shelf beam 12, and in more preferred embodiments, at least two shelf beams 12, as shown in FIGS. 1 and 4 through 6. Referring now to FIG. 2, the shelf beam 12 includes a side panel 22 of substantially greater height than thickness, and having a top edge 22*a* and a bottom edge 22*b*. The shelf beam 12 further includes a shelf member 24, attached to or formed integrally with one face of the side panel 22, substantially perpendicular to the side panel and running substantially along the length of the shelf beam 12. Most preferably, as seen in FIG. 2, the shelf member 24 protrudes from the side panel 22 at a line about two-thirds of the way from the bottom edge 22*b* toward the top edge 22*a*. In the most preferred embodiment, shown in FIG. 2, the shelf member 24 has a proximal edge 26 that is attached to the side panel 22, and a distal edge 28 opposite. If the shelf member 24 is attached to the side panel 22, the attachment may be any suitable permanent attachment, such as by welding. If the shelf member 24 is formed integrally with the side panel 22, such formation may be accomplished by extrusion or any other suitable method of formation. Further, while the material of the shelf beam 12 may be any suitably light, strong, and inexpensive material, the most preferred material is aluminum. The shelf member 24 generally has a uniform upper surface, but in the most preferred embodiment, as seen in FIG. 2, the shelf member has an upper surface with a proximal tier 30 and a distal tier 32, the upper surface of the proximal tier 30 being slightly higher than that of the distal tier 32.

Figure 3:
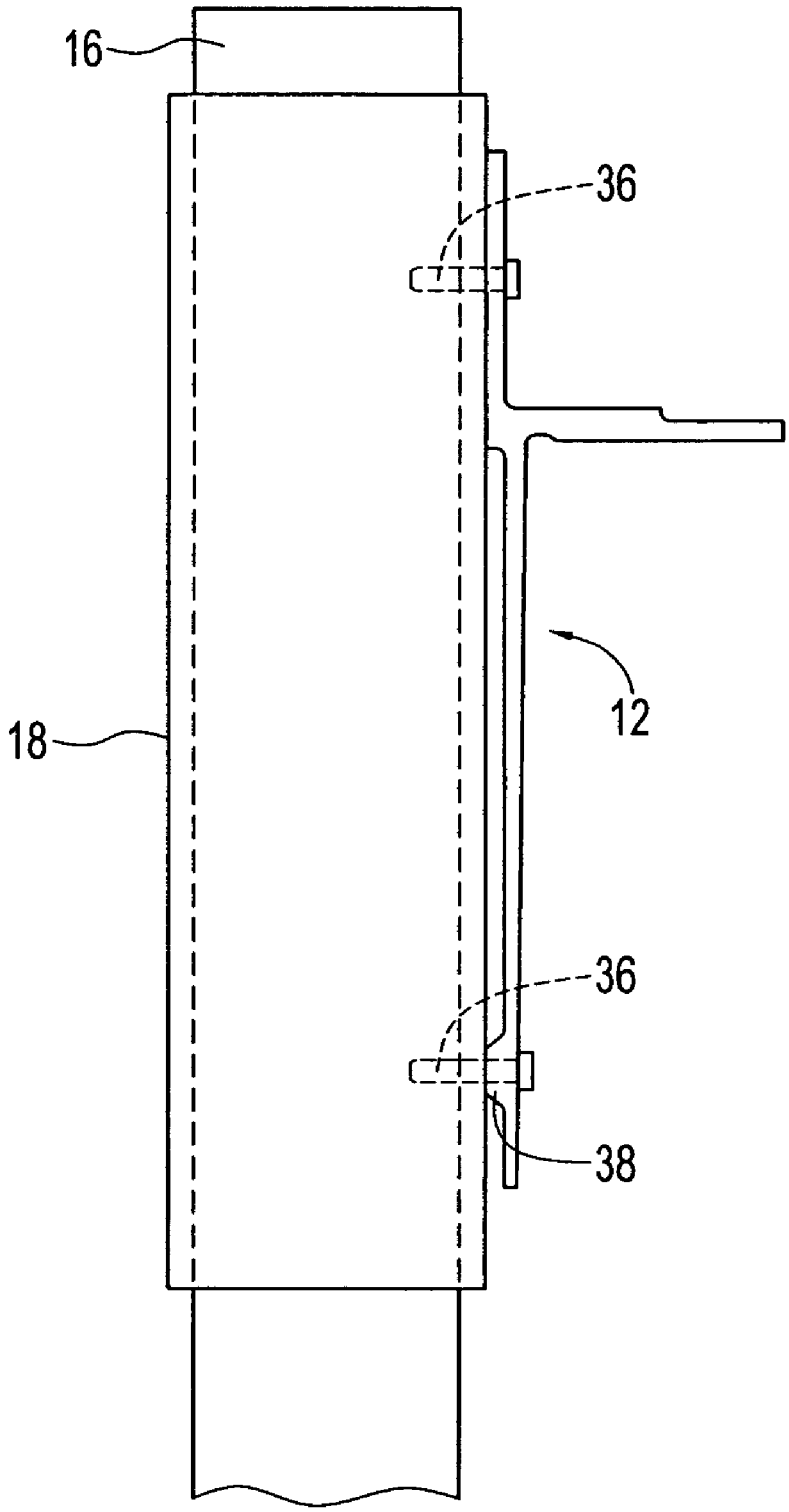
FIG. 3 is a cross-sectional view of the shelf beam, coupled to a support post and sleeve, according to yet another embodiment of the present invention.
Figure 4:
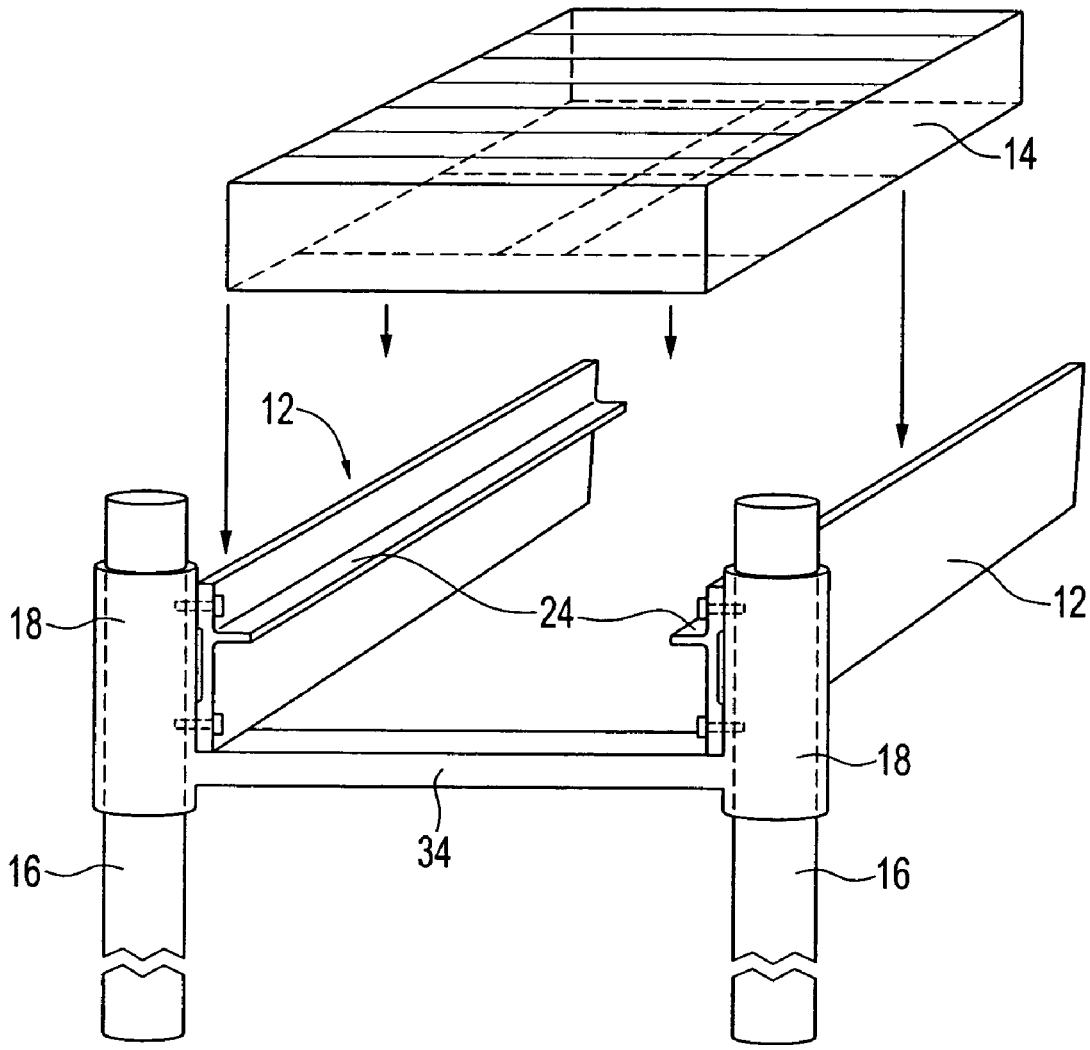
FIG. 4 is a partially exploded perspective view of a pier constructed according to another embodiment of the present invention.
Figure 5:
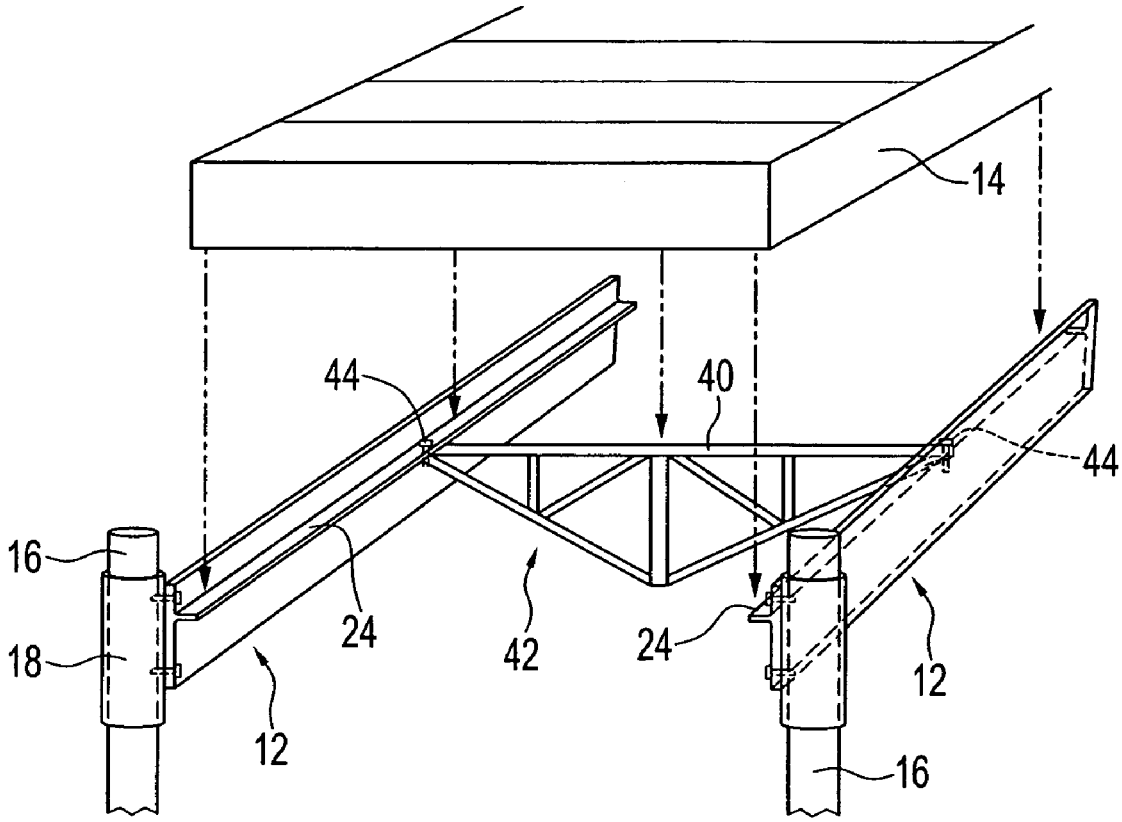
FIG. 5 is a partially exploded perspective view of a pier constructed according to yet another embodiment of the present invention.
Figure 5A:
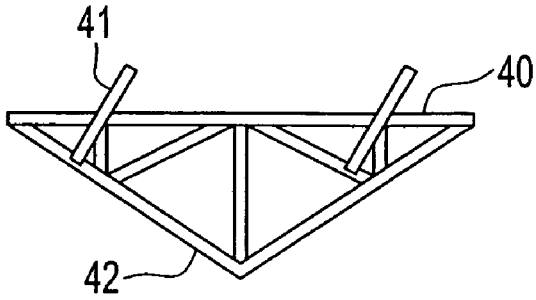

As shown in FIG. 3, the invention provides that the shelf beam 12 is connected to at least one support post 16. In the preferred embodiment shown in FIG. 3, the shelf beam also is connected to a sleeve 18 that slides axially around the support post 16. Further, in the embodiments shown in FIGS. 1, 4, and 6, the sleeve 18 is connected to at least one other sleeve 18 by a sleeve connector 34, which increases stability of the pier system. The sleeve connector 34 may be attached to the sleeves 18 by any suitable attachment, such as by welding, or may be formed integrally with the sleeves 18. The sleeve connector 34 may be supported against the sleeve 18 by a gusset 35 that may be attached by any suitable method. Once the sleeve 18 is positioned at the desired height around the support post 16, the shelf beam 12 is fastened to the sleeve 18 and the sleeve 18 to the support post 16, by any suitable removable fasteners 36, such as lag screws or nails. Alternatively, the sleeve 18 may be connected to the support post 16 separately from its connection to the shelf beam 12. In another embodiment, the sleeve 18 is coupled to a clamp 37 having two clasping members 37*a, b*. The first clasping member 37*a* is fixedly attached to the sleeve 36. The second clasping member 37*b* is removably attached to the support post 16. Once the desired height if obtained for the support post 16, the first and second clasping members 37*a, b* are coupled to form a clamp 37. Clasping members 37*a, b* may be coupled by any means known to one of ordinary skill in the art. To further increase stability of the pier system, the bottom end of the support posts 16 may be coupled to support anchors 39, in the shapes such as discs or other suitable structures, that rest upon the bottom of a body of water.

As can be seen in FIGS. 2 and 3, to facilitate the attachment of the sleeve 18 to the post 16, in the most preferred embodiment, the shelf beam 12 is provided with at least one boss 38. A lower boss 38*a* is formed near the lower end of the shelf beam 12, and an upper boss 38*c* is formed near the upper end of the shelf beam 12. Both bosses 38*a*, 38*c* are formed on the face of the side panel 22 opposite the shelf member 24. Fasteners 36 (FIG. 3) are then passed through openings (not shown) in the bosses 38*a*, 38*c* as the shelf beam 12 is connected to the sleeve 18 or the support post 16 (or both), and the attachment of the shelf beam 12 to the support post 16 is thereby strengthened.

Figure 6:
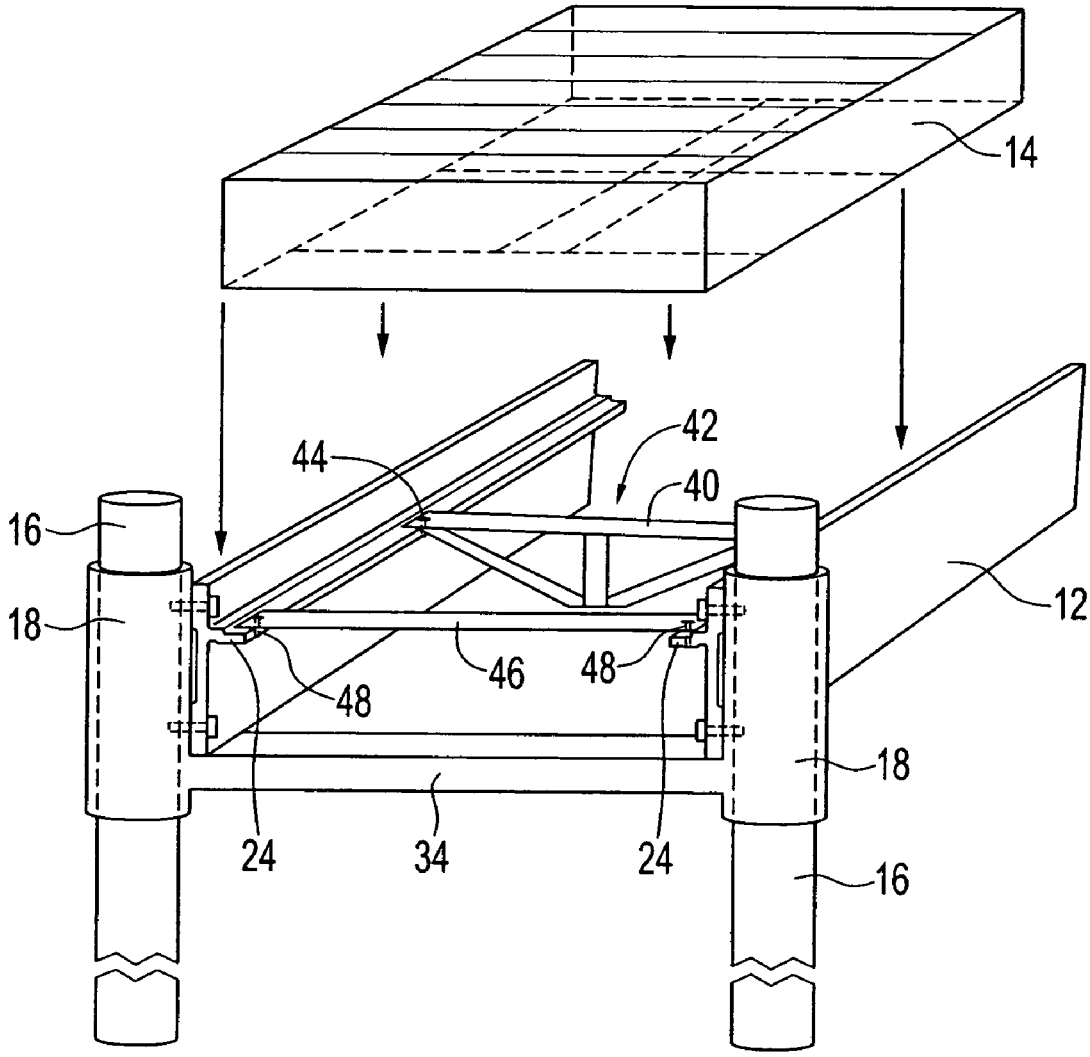
FIG. 6 is a partially exploded perspective view of a pier constructed according to yet another embodiment of the present invention.

A decking unit 14 rests upon the shelf members 24 of the shelf beams 12, as shown in the embodiments illustrated in FIGS. 1 and 4 through 6. In the most preferred embodiment, the decking unit 14 supports at least 1000 lbs. In one embodiment, illustrated in FIG. 5, the decking unit 14 rests upon the main crossbeam 40 of at least one inverted truss 42, which truss 42 provides additional load-bearing ability. The main crossbeam 40 spans the distance between two points on the shelf members 24, and is fixedly coupled to the shelf members 24 by truss fasteners 44. One of ordinary skill in the art may make the truss 42 of a variety of materials, however, in the most preferred embodiment, the truss 42 is made of aluminum. Also, one of ordinary skill in the art may make the truss 42 in a number of dimensions, but in the preferred embodiment, the truss 42 is an isosceles triangle. In yet another embodiment, as illustrated in FIG. 6, the decking unit 14 rests upon a support bar 46. The support bar 46 spans a distance between two points on the shelf members 24, and is fixedly coupled to the shelf members by support bar fasteners 48. To provide additional support for the decking unit 14 and stability of the pier system, the main crossbeam 40 or the support bar 46 may be coupled to one or more support ties 41 that attach perpendicularly to the main crossbeam 40 or support bar 46, and further support the decking unit 14.

Various embodiments of the present invention may be made by one skilled in the art. In one embodiment, the ratio of the height of the lower section 22*d* of the side panel 22, that portion of the side panel 22 below the shelf 24, to the height of the upper section 22*c* of the side panel 22, is at least 1:1. In another embodiment, this ratio is at least 5:1. The greater ratio increases the load bearing capacity of the shelf member 24. In another embodiment, the height of the lower section 22*d* and upper section 22*c* are at least 8 inches. The inventor has found that having an upper section 22*c* and a lower section 22*d* of at least 8 inches increases the load bearing capacity of the pier system.

In the most preferred embodiment of the shelf beam 12, as illustrated in FIG. 2, the shelf beam 12 has a shelf member 24 that protrudes from the side panel 22 about 70% of the way up from the bottom edge 22*b* toward the top edge 22*a*. Also in this embodiment, the shelf beam 12 has a central boss 38*b*, on the portion of the side panel 22 opposite the shelf member 24. As seen in FIGS. 2 and 3, the shelf member 24 of the shelf beam 12 has an upper proximal tier 30 and a lower distal tier 32. Both tiers 30, 32 are substantially perpendicular to the side panel 22, with the distal tier 32 about one-eighth inch lower than the proximal tier 30. This two-tiered construction of the shelf member 24 permits the simultaneous support by the shelf member 24 of a truss 42 (FIG. 5) and/or support bar 46 (FIG. 6) on the distal tier 32, and of a decking unit 14 on the proximal tier 30. Also in this embodiment, as seen in FIG. 6, a decking unit 14 may rest simultaneously upon the proximal tier 30 of a shelf member 24 and upon the main crossbeam 40 of a truss 42 or upon a support bar 46.

As described above, in the most preferred embodiment, as seen in FIGS. 2 and 3, the shelf member 24 of the shelf beam 12 has an upper proximal tier 30 and a lower distal tier 32. Both tiers 30, 32 are substantially perpendicular to the side panel 22, with the distal tier 32 about one-eighth inch lower than the proximal tier 30. This two-tiered construction of the shelf member 24 permits the simultaneous support by the shelf member 24 of a truss 42 (FIG. 5) and/or support bar 46 (FIG. 6) on the distal tier 32, and of a decking unit 14 on the proximal tier 30. Also in this embodiment, as seen in FIG. 6, a decking unit 14 may rest simultaneously upon the proximal tier 30 of a shelf member 24 and upon the main crossbeam 40 of a truss 42 or upon a support bar 46.

In the most preferred embodiment, as seen in FIG. 2, junctions between planar surfaces of the shelf beam 12 are arcuate. For example, a first junction, 50 between the proximal tier 30 and the distal tier 32 of the shelf member 24, is arcuate. Similarly, a second junction, 52 between the bottom edge 22*b* of the shelf member 24 and the side panel 22, also is arcuate. Having arcuate (as opposed to angular) junctions facilitates extrusion and increases the strength of the various junctions of the shelf beam.

Figure 7:
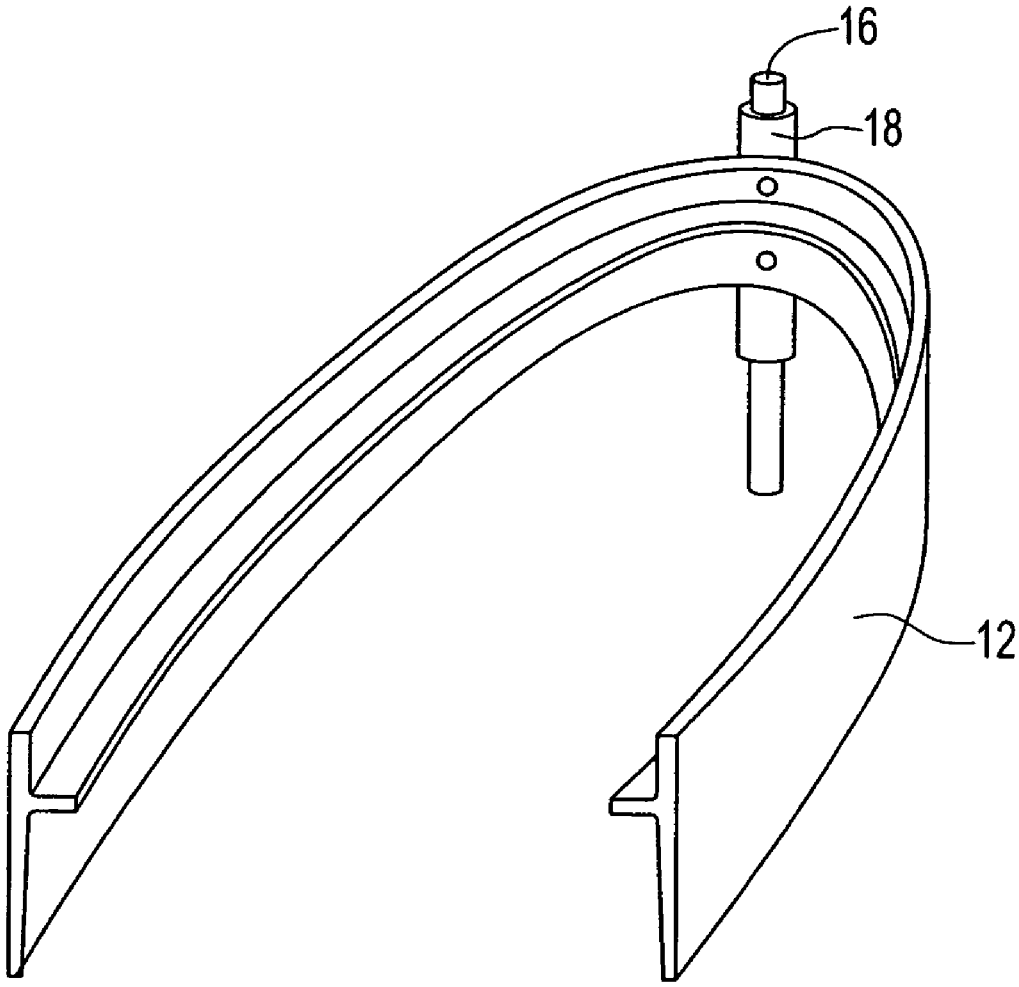
FIG. 7 is a perspective view of a shelf beam used in another embodiment of the present invention.
Figure 8:
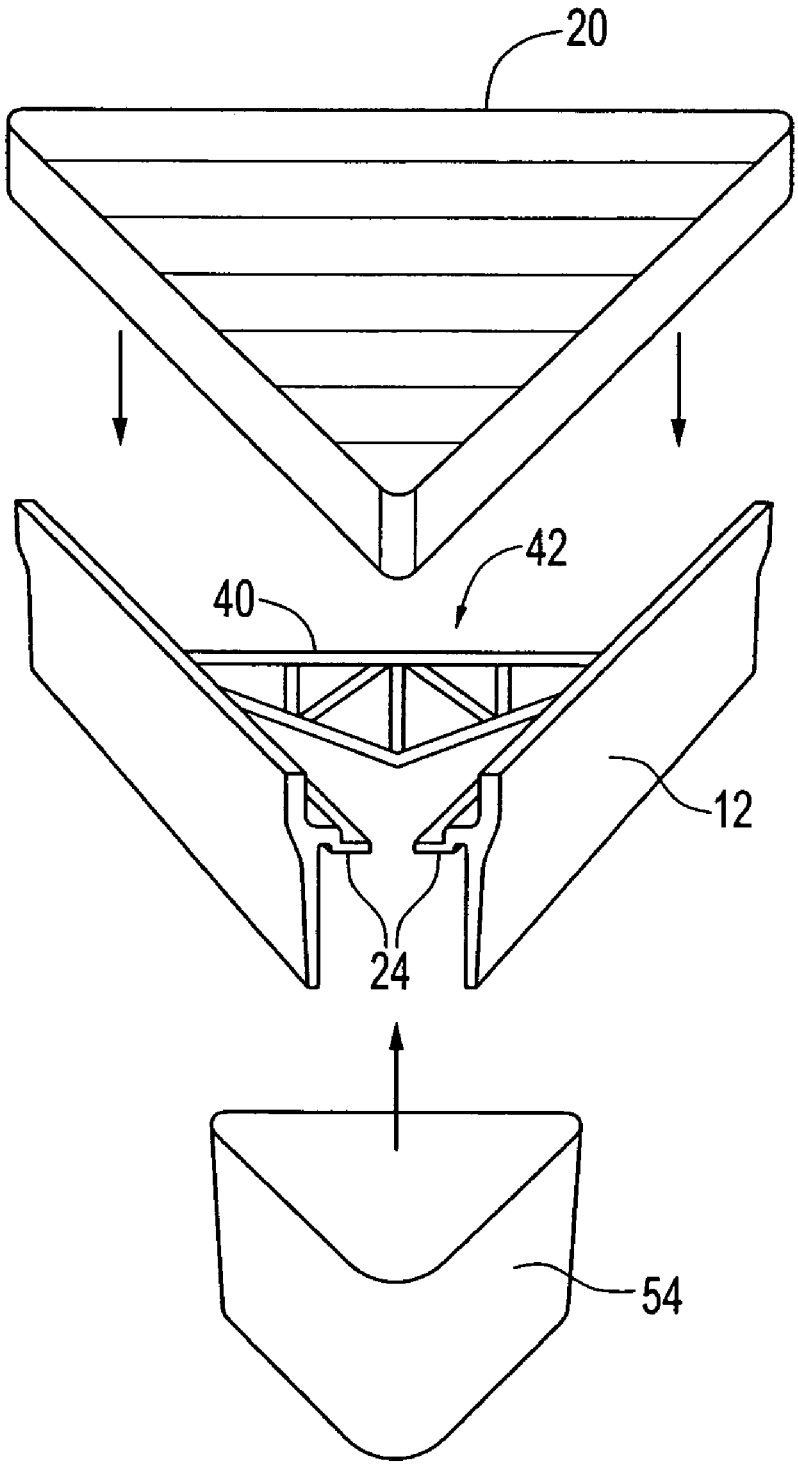
FIG. 8 is a partially exploded perspective view of a pier constructed according to yet another embodiment of the present invention.
Figure 9:
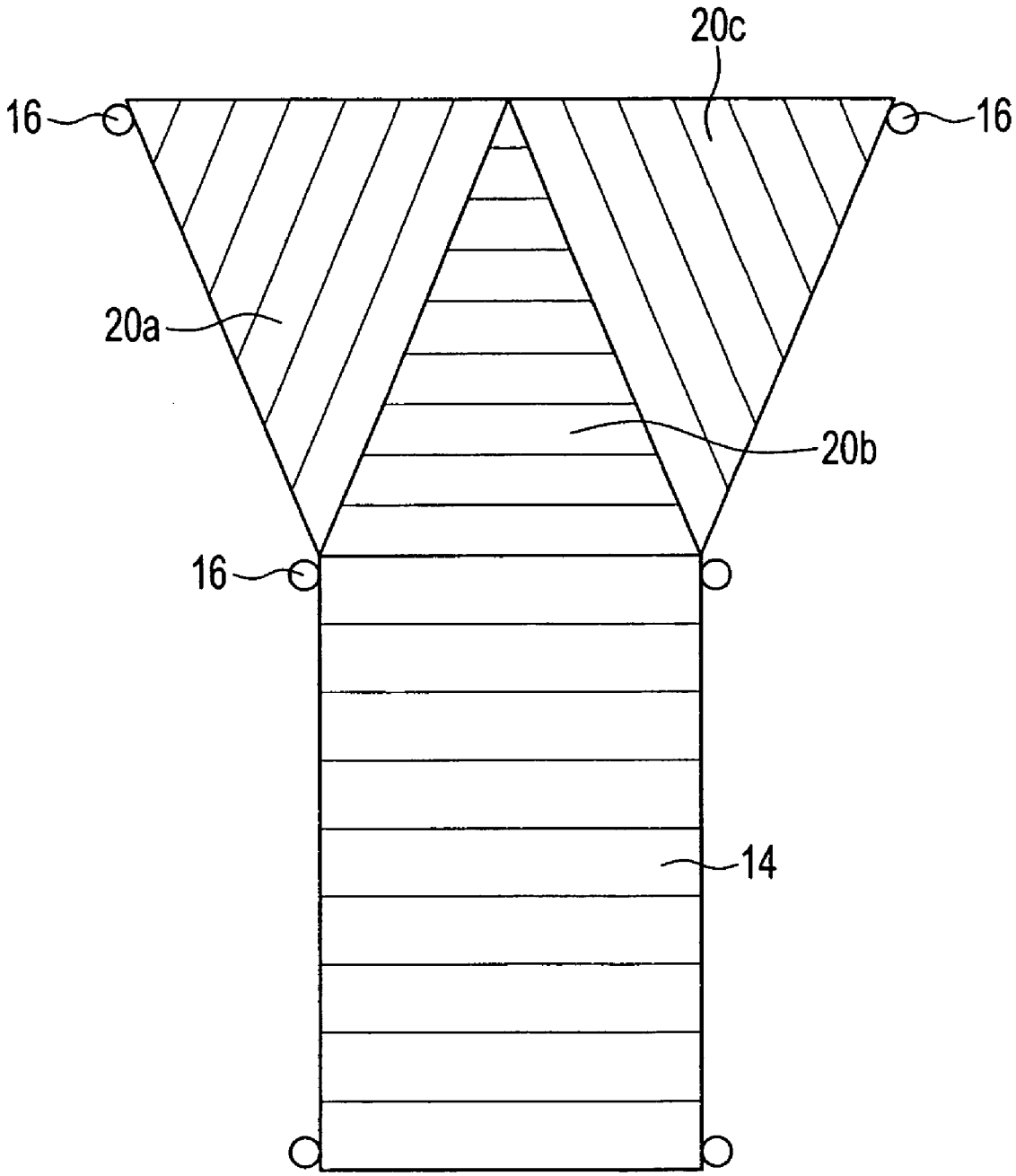
FIG. 9 is a top plan view of a pier constructed according to another embodiment of the present invention.

The present invention envisions various combinations of shapes and sizes of shelf beams 12 and decking units 14. For example, in one embodiment, seen in FIG. 7, a single shelf beam 12 is curved or otherwise shaped in a form, such as a semicircle or "U" that allows a single shelf beam to support a decking unit. In some embodiments, the decking unit 14 is substantially rectangular (FIGS. 1, 4–6), and in another embodiment, the decking unit 20 is substantially triangular (FIG. 8). In yet another embodiment, shown in FIG. 9, the invention combines a substantially rectangular decking unit 14 and three substantially triangular decking units 20*a*, 20*b*, 20*c*.

Another aspect of the present invention describes a method of constructing the pier system 10. In this method, a first pier frame is erected, which pier frame generally includes at least two shelf beams 12, coupled to at least two support posts 16. Further, a decking unit 14 is positioned upon the first pier frame so that the decking unit 14 rests upon the shelf members 24 of the shelf beams 12. The pier system may be extended to a desired length by coupling a second pier frame to the first pier frame and positioning a decking unit 14 upon the second pier frame and repeating this process. The first and second pier frames may also have inverted trusses 42 and/or support bars 46 coupled to the shelf members 24 of their shelf beams 12, as shown in FIG. 6. The present invention envisions various shapes of pier systems, pier frames, and decking units, such as substantially rectangular, hexagonal, trapezoidal, or combinations thereof. In another embodiment, the pier system includes at least one flotation device 54 (FIG. 8), so that shelf beams 12 and a decking unit 14 are buoyed by the flotation device.

While the present invention has been described with reference to various embodiments, those skilled in the art will appreciate that certain substitutions, alterations, and omissions may be made without departing from the spirit of the invention. Accordingly, the foregoing description is meant to be exemplary only, and should not limit the scope of the invention set forth in the following claims.

What is claimed is:

1. A pier system, comprising:

a shelf beam having a side panel and a shelf member connected substantially along the length of the side panel;

at least one support post, coupled to the side panel of the shelf beam;

a decking unit capable of resting upon the shelf member of the shelf beam; and a sleeve axially slidable onto each support post, which is attached to the respective support post, and to which is attached the respective shelf beam.

2. The pier system according to claim 1, further comprising fasteners for coupling the side panel of each shelf beam to at least one support post.

3. The pier system according to claim 1, wherein the shelf beam is made of extruded aluminum.

4. The pier system according to claim 1, wherein the ratio of the length of the side panel above the shelf member to the length of the side panel below the shelf member is at least 1:1.

5. The pier system according to claim 1, wherein the ratio of the length of the side panel above the shelf member to the length of the side panel below the shelf member is at least 5:1.

6. The pier system according to claim 1, wherein the decking unit is substantially triangular.

7. The pier system according to claim 1, further comprising:

a support bar coupled to the shelf members, which is capable of spanning the distance between two points on the shelf members of the beams; and a plurality of support bar fasteners for fixedly coupling the support bar to the shelf members.

8. The pier system according to claim 1, further comprising:

an inverted truss having a main crossbeam coupled to the shelf members, the main crossbeam of which is capable of spanning the distance between two points on the shelf members of the beams; and a plurality of truss fasteners for fixedly coupling the truss to the shelf members.

9. The pier system according to claim 8, wherein the truss contains aluminum.

10. The pier system according to claim 8, wherein the truss is in the shape of an isosceles triangle; and the main crossbeam of the truss is perpendicularly, fixedly coupled to at least one support tie.

11. A pier system, comprising:

at least two shelf beams, each having a side panel and a shelf member connected substantially along the length of the side panel;

at least two support posts, coupled to the side panel of each of the shelf beams;

a decking unit capable of resting upon the shelf members of the at least two shelf beams;

an inverted truss having a main crossbeam coupled to the shelf members, the main crossbeam of which is capable of spanning the distance between two points on the shelf members of the beams; and at least two decking units, wherein the first decking unit is substantially rectangular in shape and the second decking unit is substantially trapezoid in shape.

12. A method of constructing a pier system, comprising:

erecting a first pier frame by coupling at least two shelf beams to at least two support posts;

positioning a sleeve axially slidable onto each support post, which is attached to the respective support post, and to which is attached the respective shelf beam; and positioning a first decking unit upon the first pier frame, whereby the first decking unit rests upon at least a shelf members of the beams.

13. The method according to claim 12, further comprising:

coupling a second pier frame to the first pier frame, whereby the length of the pier system is extended by one module;

positioning a second decking unit upon the second pier frame; and repeating the extension of pier frames and positioning of decking units until a pier system of desired size is achieved.

14. The method according to claim 12, wherein a flotation device is coupled to each pier frame and decking unit, whereby the flotation device buoys the shelf beams and decking unit.

* * * * *